US006608984B1

(12) United States Patent
Matsumoto et al.

(10) Patent No.: US 6,608,984 B1
(45) Date of Patent: Aug. 19, 2003

(54) IMAGE FORMING METHOD AND APPARATUS USING DEVELOPER CARRIER PRESSED INTO ENGAGEMENT WITH IMAGE CARRIER

(75) Inventors: Junichi Matsumoto, Kanagawa (JP); Katsuhiro Aoki, Kanagawa (JP); Takashi Hodoshima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/556,968

(22) Filed: Apr. 24, 2000

(30) Foreign Application Priority Data

Apr. 23, 1999 (JP) ..... 11-115735
Jul. 19, 1999 (JP) ..... 11-204041

(51) Int. Cl.[7] ..... G03G 15/08
(52) U.S. Cl. ..... 399/279
(58) Field of Search ..... 399/281, 286, 399/265, 279, 228, 234

(56) References Cited

U.S. PATENT DOCUMENTS

| | | | | |
|---|---|---|---|---|
| 4,809,036 A | * | 2/1989 | Yamashita et al. | 399/286 |
| 4,814,816 A | * | 3/1989 | Idenawa | 399/234 |
| 4,899,689 A | * | 2/1990 | Takeda et al. | 399/286 |
| 5,109,254 A | | 4/1992 | Oka et al. | |
| 5,339,141 A | | 8/1994 | Suzuki et al. | |
| 5,341,196 A | | 8/1994 | Hodoshima et al. | |
| 5,416,568 A | | 5/1995 | Yoshiki et al. | |
| 5,424,814 A | | 6/1995 | Suzuki et al. | |
| 5,450,177 A | | 9/1995 | Oyama | |
| 5,467,175 A | | 11/1995 | Takagaki et al. | |
| 5,561,506 A | | 10/1996 | Kasahara | |
| 5,565,973 A | | 10/1996 | Fujishiro et al. | |
| 5,585,598 A | | 12/1996 | Kasahara et al. | |
| 5,598,254 A | | 1/1997 | Ikesue et al. | |
| 5,655,193 A | | 8/1997 | Fujishiro et al. | |
| 5,659,860 A | | 8/1997 | Sasaki et al. | |
| 5,771,426 A | | 6/1998 | Oka et al. | |
| 5,774,772 A | | 6/1998 | Kai et al. | |
| 5,797,074 A | | 8/1998 | Kasahara et al. | |
| 5,805,965 A | | 9/1998 | Tsuda et al. | |
| 5,822,664 A | | 10/1998 | Oka et al. | |
| 5,864,733 A | | 1/1999 | Mae et al. | |
| 5,875,380 A | | 2/1999 | Iwata et al. | |

(List continued on next page.)

FOREIGN PATENT DOCUMENTS

| | | | | |
|---|---|---|---|---|
| JP | 62138874 A | * | 6/1987 | G03G/15/08 |
| JP | 03292434 A | * | 12/1991 | F16F/15/10 |
| JP | 6-258933 | | 9/1994 | |
| JP | 6-295130 | | 10/1994 | |
| JP | 08030100 A | * | 2/1996 | G03G/15/08 |
| JP | 08211739 A | * | 8/1996 | G03G/15/08 |
| JP | 08-297389 | * | 11/1996 | |
| JP | 8-305075 | | 11/1996 | |
| JP | 9-179389 | | 7/1997 | |
| JP | 9-197713 | | 7/1997 | |
| JP | 2715337 | | 11/1997 | |
| JP | 10-69162 | | 3/1998 | |
| JP | 11-84878 | | 3/1999 | |
| JP | 11-149174 | | 6/1999 | |

*Primary Examiner*—Robert Beatty
(74) *Attorney, Agent, or Firm*—Oblon, Spivak, McClelland, Maier & Neustadt, P.C.

(57) ABSTRACT

An image forming apparatus of the type which develops a latent image on an image carrier with toner stored in a developing unit and transferring the resulting toner image to a recording medium. The developing unit includes a developer carrier which contacts the image carrier at least at two spaced apart points with a gap being formed between the at least two points of contact. A moving mechanism will move opposite ends of the developer carrier independent distances relative to one another so as to eliminate the gap and establish full contact between the image carrier surface and developer carrier surface.

10 Claims, 10 Drawing Sheets

U.S. PATENT DOCUMENTS 5,915,155 A 6/1999 Shoji et al.
5,953,567 A 9/1999 Muramatsu et al.
5,987,298 A 11/1999 Muramatsu et al.
6,081,680 A * 6/2000 Nomura et al. ..... 399/159
6,081,684 A 6/2000 Naganuma et al.
6,112,046 A 8/2000 Suzuki et al.
6,125,243 A 9/2000 Shoji et al.
6,128,459 A 10/2000 Iwata et al.
6,142,690 A 11/2000 Yoshimura et al.
6,160,979 A 12/2000 Shoji
6,163,669 A 12/2000 Aoki et al.
6,201,941 B1 3/2001 Kasahara et al.
6,282,396 B1 8/2001 Iwata et al.
6,295,437 B1 9/2001 Hodoshima et al.
6,366,751 B1 4/2002 Shakuto et al.
6,381,435 B2 4/2002 Shinohara et al.
6,385,423 B1 5/2002 Kai
6,393,241 B1 5/2002 Matsumoto et al.
6,442,364 B2 8/2002 Kai et al.
6,449,452 B1 9/2002 Kai
6,456,806 B2 9/2002 Shoji et al.
6,507,720 B2 1/2003 Kabumoto et al.

* cited by examiner

*Fig. 13*

| DRUM | NO TREATMENT | | APPLICATION OF ZINC STEARATE | | SILICONE OIL |
|---|---|---|---|---|---|
| $\mu$ | 0.57~0.59 | | 0.22~0.25 | | 0.2 |
| DEVELOPING ROLLER HARDNESS (JIS-A) | 40° | 20° | 40° | 20° | 40° |
| SURFACE LAYER | SD-1 | | | | |
| 150(3g/mm) | 0.035 | 0.032 | 0.006 | 0.004 | 0.009 |
| 200(4g/mm) | 0.035 | 0.034 | 0.008 | 0 | 0.165 |
| 300(6g/mm) | | | 0.005 | 0.005 | 0.021 |
| 400(8g/mm) | 0.021 | 0.025 | 0.008 | 0.005 | 0.013 |
| 500(10g/mm) | | | | 0.005 | |
| 600(12g/mm) | 0.024 | 0.020 | 0.005 | 0 | 0.007 |
| 700(14g/mm) | | | 0.009 | 0 | 0.146 |
| 800(16g/mm) | | | | 0 | 0.084 |
| 900(18g/mm) | | | | 0 | |

LINEAR SPEED RATIO TO DRUM (X1.2)

TARGET VALUE ($\Delta$ID)<0.02

BANDING

OMISSION OF LEADING EDGE

= IRREGULAR SOLID IMAGE

| KIND OF TONER | TONER : A | TONER : B |
|---|---|---|
| LOOSE APPARENT DENSITY | 0.3 | 0.42 |
| HALFTONE IMAGE | × | ○ |

| KIND OF TONER | TONER : A | TONER : B |
|---|---|---|
| LOOSE APPARENT DENSITY | 0.35 | 0.47 |
| HALFTONE IMAGE | × | ○ |

IMAGE FORMING METHOD AND APPARATUS USING DEVELOPER CARRIER PRESSED INTO ENGAGEMENT WITH IMAGE CARRIER

BACKGROUND OF THE INVENTION

The present invention relates to an image forming method and a printer, copier, facsimile apparatus or similar image forming apparatus using the same. More particularly, the present invention relates to an image forming apparatus of the type developing a latent image formed on a photoconductive drum or similar image carrier with toner or similar developer stored in a developing unit and transferring the resulting toner image to a paper sheet or similar recording medium.

An image forming apparatus of the type described is operable with a magnetic or nonmagnetic single ingredient type developer for developing a latent image electrostatically formed on an image carrier. A developing system using this type of developer includes a developer carrier contacting the image carrier while carrying the developer thereon in the form of a thin layer. The developer carrier is implemented as an elastic developing roller. With such a developing system, it is possible to obviate the scattering of the developer and thereby enhance the reproducibility of dots by, e.g., increasing a contact pressure between the image carrier and the developer carrier and a linear velocity ratio of the developer carrier to the image carrier.

However, the above developing system is susceptible to the fine oscillation of the image carrier and developer carrier. For example, when the contact pressure is increased, a drive source for setting the contact pressure must bear a heavy load. This is likely to bring about defective images ascribable to banding caused by irregular rotation.

To prevent the load on the drive source from increasing, the contact pressure of the developer carrier acting on the image carrier may be reduced, as proposed in the past. This conventional scheme, however, has a problem that the contact pressure is lower at the axially intermediate portion of the developer carrier than at the axially opposite end portions, causing the intermediate portion of an image to be lost. In light of this, Japanese Patent Laid-Open Publication No. 10-20857, for example, teaches a developer carrier having an intermediate portion greater in diameter than opposite and portions.

The developer carrier is generally formed of rubber. However, it is difficult to achieve dimensional accuracy with rubber, as distinguished from metal. This is particularly true when rubber has low hardness. In this condition, should the contact pressure between the image carrier and the developer carrier be lowered to reduce the load on the drive source, contact between them would easily become non-uniform and render irregularities conspicuous in an image. It is therefore necessary to strictly control the dimensional accuracy of the developer carrier. The dimensional accuracy involves various parameters, e.g., a tolerance in outside diameter, oscillation and cylindricality. However, despite the control over such parameters, it is sometimes difficult to reduce irregular images due to conditions in which the developer carrier is mounted. In addition, strict control over the dimensional accuracy increases cost.

The developer layer, or toner layer, deposited on the developer carrier contacts the surface of the image carrier. In this condition, an electrostatic force exerted by a latent image formed on the image carrier attracts toner existing in the toner layer and causes it to deposit on the latent image. In practice, however, a non-electrostatic force derived from e.g., the contact condition between the toner layer and the image carrier often causes the toner to deposit on the image carrier, particularly the background thereof where the electrostatic force of the latent image does not act on the toner. This contaminates the background to a noticeable degree.

Japanese Patent Laid-Open Publication No. 8-254933, for example, discloses an arrangement for obviating the background contamination of the image carrier. The arrangement is such that toner density outside the image area of the image carrier is sensed to determine the degree of background contamination. A device for applying a lubricant is held in contact with the image carrier. The amount of the lubricant to be applied to the image carrier is controlled in terms of a contact pressure in accordance with the degree of background contamination, thereby enhancing a cleaning effect.

Japanese Patent Publication No. 7-117788, for example, proposes a developing device operable with a nonmagnetic single ingredient type developer. In the developing device taught in this document, the amount of developer to deposit on the developer carrier is selected to be 0.6 mg/cm$^2$ to 1.2 mg/cm$^2$. In addition, the ratio of the moving speed V1 of the developer carrier to the moving speed V2 of the image carrier is confined in the range of $0.6 \leqq V1/V2 \leqq 0.9$. Those specific conditions are used to mechanically remove developer particles adhering to each other with a weak force without increasing the drive force.

The above lubricant scheme and linear speed ratio scheme, however, have a drawback that because the image carrier and developer carrier contact each other via the toner layer, the toner is apt to deposit on the image carrier due not only to the electrostatic force but also to the non-electrostatic force. This aggravates the background contamination of the image carrier.

To solve the above problem, it is a common practice to increase the contact pressure and linear velocity ratio at the time when image forming process conditions are set. The contact pressure, however, causes the previously stated banding to occur when increased. Also, the linear speed ratio of the developer carrier to the image carrier is apt to cause the toner to concentrate at the trailing edge of an image when increased.

On the other hand, the toner deposits on the developer carrier in a plurality of layers each having a particular amount of charge. Part of the toner existing in upper layers and short of charge are scattered onto the image carrier, contaminating the background of the image carrier. Further, as the toner coheres due to aging, an adhering force acting between toner particles increases and makes it difficult for them to migrate toward the image carrier when a halftone image, for example, is to be formed. This prevents a halftone image from being faithfully reproduced. Moreover, a defective image ascribable to banding becomes more conspicuous as the toner layer becomes thicker. Specifically, although a regulating member causes the toner to form a thin layer, any change in the contact pressure of the regulating member ascribable to irregular rotation makes the toner layer thickness irregular. Consequently, among toner particles existing on the developer carrier, the particles in upper layers not firmly deposited despite the electrostatic and non-electrostatic forces are susceptible to a change in thickness, causing the thickness of the toner layer to vary.

Japanese Patent Laid-Open Publication No. 9-197713, for example, teaches a method for obviating the fall of image density and tonality, paying attention to the fact that the cohesion of toner, among others, effects the reproducibility of a halftone image, as stated above. The method consists in specifying the variation of a degree of cohesion, an angle of repose and a loose apparent specific gravity due to aging as well as the configuration of toner particles. Also, Japanese Patent Laid-Open Publication No. 9-73229 proposes to specify the bulk density of the thin toner layer and the amount of toner to deposit on the image carrier for preventing an image from being blurred.

However, the above Laid-Open Publication No. 9-197713 contemplates to prevent image density from falling and therefore assumes a condition wherein the maximum amount of toner to deposits. The above Laid-Open Publication No. 9-73229 contemplates to increase image density by preventing the toner from depositing on a non-image area and, for this purpose, makes the thickness of the thin toner layer uniform. None of such schemes is therefore directed toward a halftone image. More specifically, the image carrier and developer carrier sandwich the toner at a nip for development and cause it to easily cohere. Cohesion increases the packing density of the toner and therefore the adhering force acting between the toner particles, degrading the reproducibility of a halftone image.

Technologies relating to the present invention are also disclosed in, e.g., Japanese Patent Laid-Open Publication Nos. 4-372981, 6-258933, 6-295130, 8-305075, 9-179389, 10-69162, 11-84878 and 11-149174 as wall as in Japanese Patent No. 2,715,337.

SUMMARY OF THE INVENTION

It is therefore a first object of the present invention to provide an image forming apparatus capable of reducing irregular images without increasing cost by including a developer carrier contacting an image carrier and provided with dimensional accuracy based on new criteria.

It is another object of the present invention to provide an image forming apparatus of the type including a developer carrier for electrostatically retaining a developer thereon and a regulating member for causing the developer to form a thin layer, and capable of protecting the image carrier from background contamination and insuring faithful reproduction of a halftone image.

In accordance with the present invention, in an image forming method for electrostatically forming a latent image on the uniformly charged surface of an image carrier by optical writing, causing a developer carrier on which a single ingredient type developer is deposited to contact the image carrier to thereby develop it while controlling a contact pressure, transferring the developed image to a recording medium, and fixing the developed image on the recording medium, the developer carrier is implemented as a cylindrical member. Assume that any two points on ridgelines are connected by a line in any section passing through the axis of the developer carrier, that the maximum distance between ridgelines present between the above line and the two points is T in the normal direction, and that the displacement of the developer carrier to occur when a contact pressure is applied to the developer carrier located at one side between the two points and contacting facing one of the ridgelines with no load is L. Then, there holds a relation:

$$T<L$$

Also, in accordance with the present invention, in an image forming apparatus for electrostatically forming a latent image on the surface of an image carrier having a coefficient of friction $\mu$ lying in a range of $0.1 \leqq \mu \leqq 0.4$ and uniformly charged beforehand by optical writing, causing a developer carrier on which a single ingredient type developer is deposited to contact the image carrier to thereby develop the latent image while controlling a contact pressure, transferring the developed image to a recording medium, and fixing the developed image on the recording medium, the volume mean particle size Tr (cm) of the developer, the amount M ($mg/cm^2$) of the developer to deposit on the developer carrier and the bulk density $\rho$ ($mg/cm^3$) of the developer have a following relation when the developer is pressed by a pressure of 100 $gf/cm^2$:

$$0.5\ \rho Rt \leqq M \leqq 1.2\ \rho Rt$$

The developer should preferably have a loose apparent density of 0.35 or above. Also, the developer should probably have its configuration determined by sphericality and have sphericality of 90% or above with respect to true sphericality. Further, a plurality of particles should stay in the vicinity of the developer carrier.

BRIEF DESCRIPTION OF THE DRAWINGS

The above and other objects, features and advantages of the present invention will become more apparent from the following detailed description taken with the accompanying drawings in which:

FIG. 13 is a table representative of a relation between the contact pressure between the image carrier and the developer carrier and the background contamination and defective images;

DESCRIPTION OF THE PREFERRED EMBODIMENTS

Figure 1:
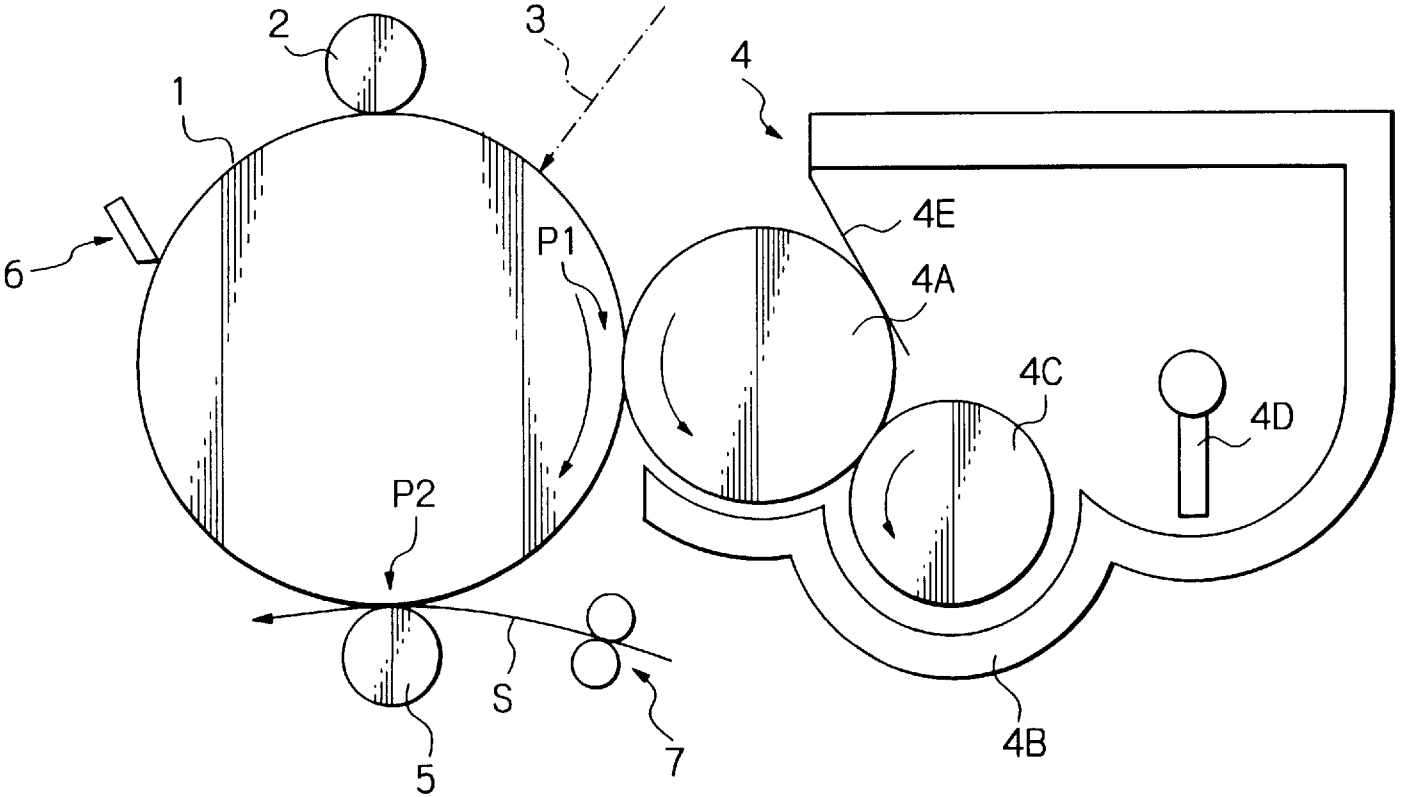
FIG. 1 is a view showing essential part of a first embodiment of an image forming apparatus in accordance with the present invention.

Preferred embodiments of the present invention will be described hereinafter. It is to be noted that because particular reference numerals are used in each embodiment, identical reference numerals do not always designate identical structural elements.

First Embodiment

Referring to FIG. 1 of the drawings, an image forming apparatus embodying the present invention is shown. The illustrative embodiment is directed mainly to the first object of the present invention stated earlier. As shown, the image forming apparatus includes a photoconductive element or image carrier implemented as a drum 1 and formed of an organic or inorganic photoconductor. A drive source, not shown, causes the drum 1 to rotate in a direction indicated by an arrow in FIG. 1. A charger 2, an optical writing device (represented by an optical path) 3, a developing unit 4, an image transfer device 5 and a cleaning device 6 are sequentially arranged around the drum 1 in the direction of rotation of the drum 1 for implementing an image forming process. The charger 2 uniformly charges the surface of the drum 1 being rotated. The optical writing device 3 exposes the charged surface of the drum 1 imagewise to thereby form a latent image on the drum 1.

The developing unit 4 develops the above latent image with a developer at a position P1 to thereby produce a corresponding toner image. A paper sheet or similar recording medium S is fed from a paper feeder (represented by a registration roller pair 7) to a position P2 where the drum 1 and image transfer device 5 face each other. The image transfer device 5 transfers the toner image from the drum 1 to the paper sheet S. After the image transfer, the cleaning device 6 scrapes off the developer left on the drum 1. Subsequently, a discharger, not shown, discharges the surface of the drum 1 to thereby prepare it for the next image forming cycle. After a fixing device, not shown, has fixed the toner image on the paper sheet S, the paper sheet S is driven out of the apparatus to a tray not shown.

In the illustrative embodiment, the developer is implemented as a single ingredient type developer, i.e., toner. Toner provided in the form of particles consists of a mixture of polyester, polyol, styrene-acryl or similar resin, a charge control agent (CCA) and a coloring agent, and silica, titanium oxide or similar substance applied to the particles. The particles have a mean particle size of 3 $\mu$m to 12 $\mu$m, 7.5 $\mu$m in the illustrative embodiment. With such a mean particle size, it is possible to meet the demand for high resolution and to further reduce the particle size for even higher resolution.

The developing device 4 includes a developing roller or developer carrier 4A for executing so-called contact development. The developing roller 4A is held in contact with the drum 1. A casing 4B also included in the developing device 4 accommodates the developing roller 4A, a feed roller 4C facing the developing roller 4A, an agitator 4D adjoining the feed roller 4C, and a metering blade or regulating member 4E contacting the developing roller 4A.

The developing roller is formed of rubber and provided with an outside diameter of 10 mm to 30 mm. For the rubber, use may be made of silicone rubber, butadiene rubber, nitrile-butadiene rubber (NBR), hydrine rubber or EPDM. The surface of the developing roller 4A may be covered with a silicone- or Teflon-based coating material in order to stabilize quality against aging, if desired. A silicone-based coating material allows the toner to be efficiently charged while the Teflon-based material has a high parting ability. In addition, the coating layer on the developing roller 4A may contain carbon black or similar conductive substance. The coating layer should preferably be 4 $\mu$m to 50 $\mu$m thick; thickness above this range is apt to cause the coating layer to crack. In the illustrative embodiment, the developing roller 4A has lower hardness than the drum 1. Alternatively, use may be made of a hard developing roller and a photoconductive element implemented as a soft belt.

The feed roller 4C is formed of foam polyurethane or similar flexible material having a cell size of 50 $\mu$m to 500 $\mu$m, so that the toner can be easily held on the surface of the roller 4C. The surface of the feed roller 4C has relatively low hardness ranging from 10° to 30°, as measured by JIS (Japanese Industrial Standards) A scale, so as to evenly contact the developing roller 4A. The surface of the feed roller 4C bites into the developing roller 4A by 0.5 mm to 1.5 mm. The feed roller 4C is rotatable in the same direction as the developing roller 4A such that the surface of the former moves in the opposite direction to the surface of the latter contacting it. The linear velocity ratio of the feed roller 4C to the developing roller 4A is selected to be between 0.5 and 1.5, 0.9 in the illustrative embodiment.

In the illustrative embodiment, the particular range of bite mentioned above implements torque ranging from 1.5 kg·fcm to 2.5 kg·fcm necessary for a unit effective width of 240 mm available with the developing unit 4. This unit effective width corresponds to the width of a paper sheet of size A4 fed in a profile position, as distinguished from a landscape position. However, a broader range of bite may be selected because the amount of bite depends on the characteristics of a motor, gear head and so forth included in a driveline assigned to the developing unit 4 as well as on the charge and feed characteristics of the toner.

Charge is frictionally induced on the toner existing on or in the surface of the feed roller 4C when brought to a nip between the feed roller 4C and the developing roller 4A. In the illustrative embodiment, negative charge is induced on the toner due to the characteristic of the toner. The toner charged to negative polarity is held on the surface of the developing roller 4A due to a conveying effect derived from the surface roughness of the roller 4A. The toner transferred from the feed roller 4C to the developing roller 4A is not uniform in thickness, but deposited to excessive thickness (1 mg/cm$^2$ to 3 mg/cm$^2$). The metering blade 4E regulates such a toner layer to uniform thickness.

The developing roller 4A rotates in a direction indicated by an arrow in FIG. 1. The metering blade 4E is affixed to the casing 4B at one end thereof. The other end of the blade 4E extends to the downstream side in the direction of rotation of the developing roller 4A. In this condition, the blade 4E contacts the circumference of the developing roller 4A at its intermediate portion between the opposite ends in a so-called counter position. The blade 4E is formed of metal, e.g., SUS 304 and 0.1 mm to 0.15 mm thick. The length of the blade 4E between the position where the blade 4E contacts the developing roller 4A and the free end is selected to be 0.1 mm to 2.0 mm.

Alternatively, the metering blade 4E may be formed of 1 mm to 2 mm thick resin having relatively high hardness, e.g., polyurethane rubber or similar rubber, silicone resin or fluorocarbon resin that inverts the charging characteristic (e.g. ETFE, PTFE or PVdF). Even materials other than metals can be lowered in resistance if, e.g., carbon black is mixed therewith. Such a metering blade 4E can form an electric field between it and the developing roller 4A with a bias applied from a bias power source.

The length of the metering blade 4E between the contact point and the free end should preferably be 8 mm to 15 mm. Lengths greater than 15 mm would make the developing device 4 bulky. Lengths small or than 8 mm would cause the blade 4E to oscillate on contacting the developing roller 4A and would thereby cause irregularities to appear in an image in the horizontal direction or otherwise make an image defective.

The metering blade 4E contacts the developing roller 4A with a pressure ranging from 1 gf/cm to 25 gf/cm. In this condition, the blade 4E crapes off non-charged toner particles deposited on the developing roller 4A and regulates the toner layer to uniform thickness. Pressure higher than 25 gf/cm would reduce the amount of toner to deposit on the developing roller 4A and increase the amount of toner charge excessively and would thereby lower image density due to short development. Pressure lower than 1 gf/cm would prevent the toner from forming a uniform thin layer and cause it to move away from the blade 4E in the form of lumps, thereby degrading image quality to a critical degree.

In the illustrative embodiment, the developing roller 4A is implemented by SUS having hardness of 40° (JIS A scale) and thickness of 0.1 mm. The contact pressure is selected to be 6 gf/cm. This allows the metering blade 4E to scrape off excess toner deposited on the developing roller 4A and form a thin toner layer having uniform thickness. The toner with an amount of charge of −5 $\mu$C/g to −30 $\mu$C/g is transferred from the developing roller 4A to a latent image formed on the drum 1.

Figures 2A, 2B:
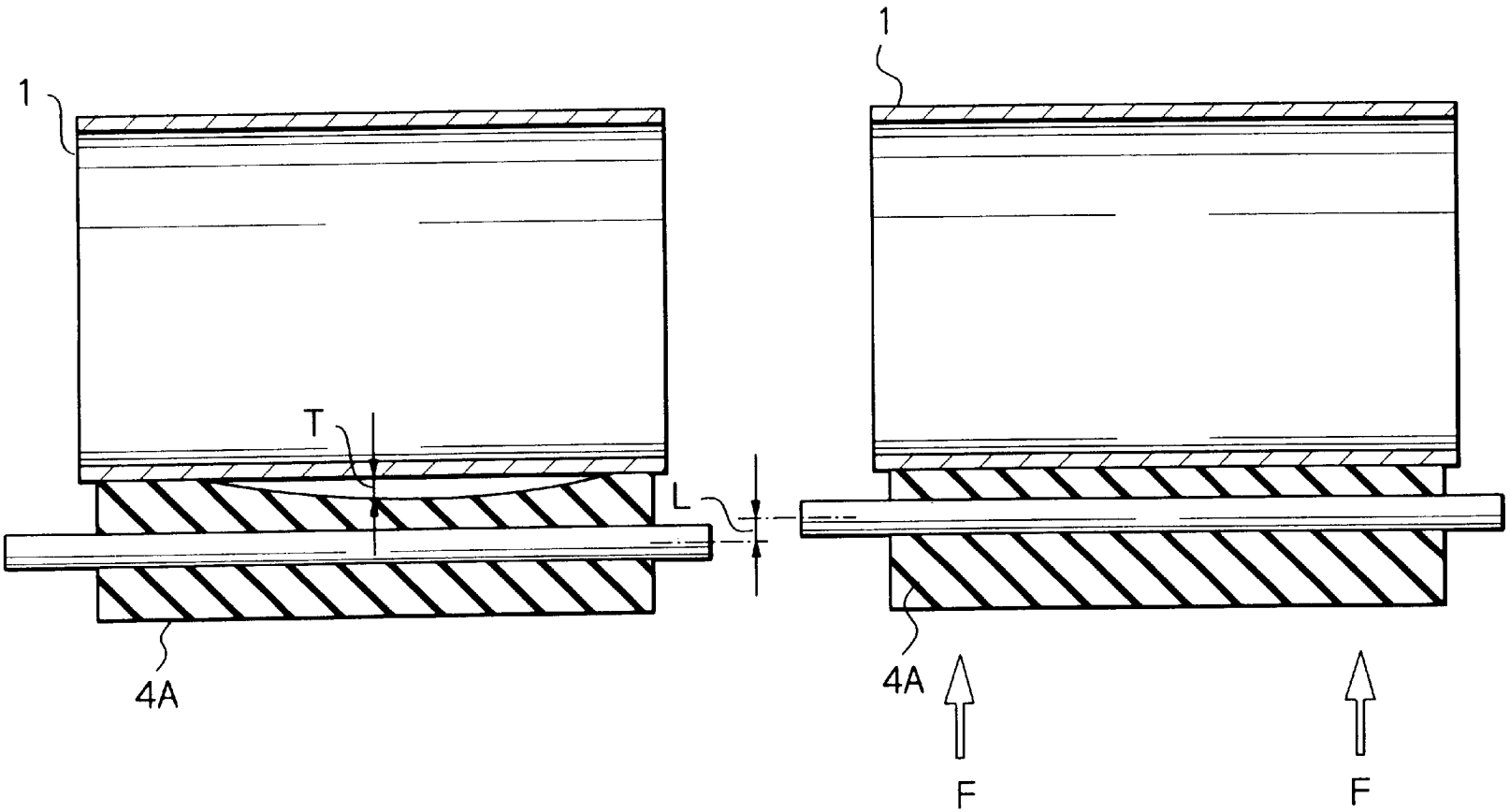
FIG. 2A is a view showing a specific condition wherein a developing roller contacts a photoconductive drum with a load of 0 g/mm.
FIG. 2B is a view showing another specific condition wherein the developing roller is pressed against the photoconductive drum by a pressure F.

The drum 1 and developing roller 4A contact each other with the intermediary of the toner layer formed on the developing roller 4A. A drive source, not shown, causes the developing roller 4A to rotate. A relation between the drum 1 and the developing roller 4A will be described specifically with reference to FIGS. 2A and 2B. FIG. 2A shows a specific condition wherein the developing roller 4A contacts the drum 1 with a load of 0 g/mm. FIG. 2B shows another specific condition wherein the developing roller 4A is pressed against the drum 1 by a pressure F. As shown, assume that the developing roller 4A moves by a distance L when pressed against the drum 1. Also, assume that any two points on ridgelines are connected by a line in any section passing through the axis of the developer carrier, and that the maximum distance between ridgelines present between the above line and two points is T in the normal direction. More specifically, the maximum distance T refers to the distance in the radial direction between the drum 1 and the developing roller 4A as to the relative position. Then, a relation of T<L holds between the drum 1 and the developing roller 4A.

More specifically, when the distance T is greater than the displacement L, a gap appears between the drum 1 and the developing roller A and brings about irregular density and local omission of an image. To avoid such a gap, it is necessary to provide the developing roller 4A with a dimension capable of reducing the distance T and to cause the roller 4A to bite into the drum 1 to such a degree that the gap disappears.

Figure 3:
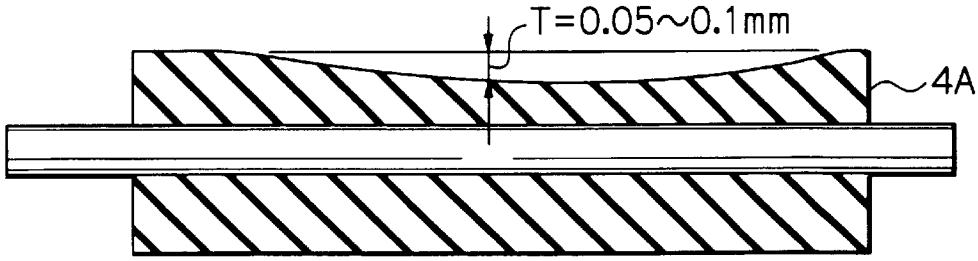
FIG. 3 is a view for describing a specific parameter relating to the illustrative embodiment.

However, if the above gap is caused to disappear, a pressure used for such a purpose makes the contact pressure non-uniform in the axial direction and results in irregular images and the need for extra drive torque. For example, assuming that the displacement L is 0.05 mm, the developing roller 4A may be provided with a tolerance of +0.05 in outside diameter in order to set up an adequate contact condition. FIG. 3 shows the resulting contour of the developing roller 4A. As FIG. 3 indicates, even when the desired displacement L is guaranteed, a gap appears and makes images irregular. In this manner, the conventional configuration cannot implement a uniform image with the outside diameter of the developing roller 4A and therefore must define the oscillation and cylindricality of the same as well.

Figure 4:
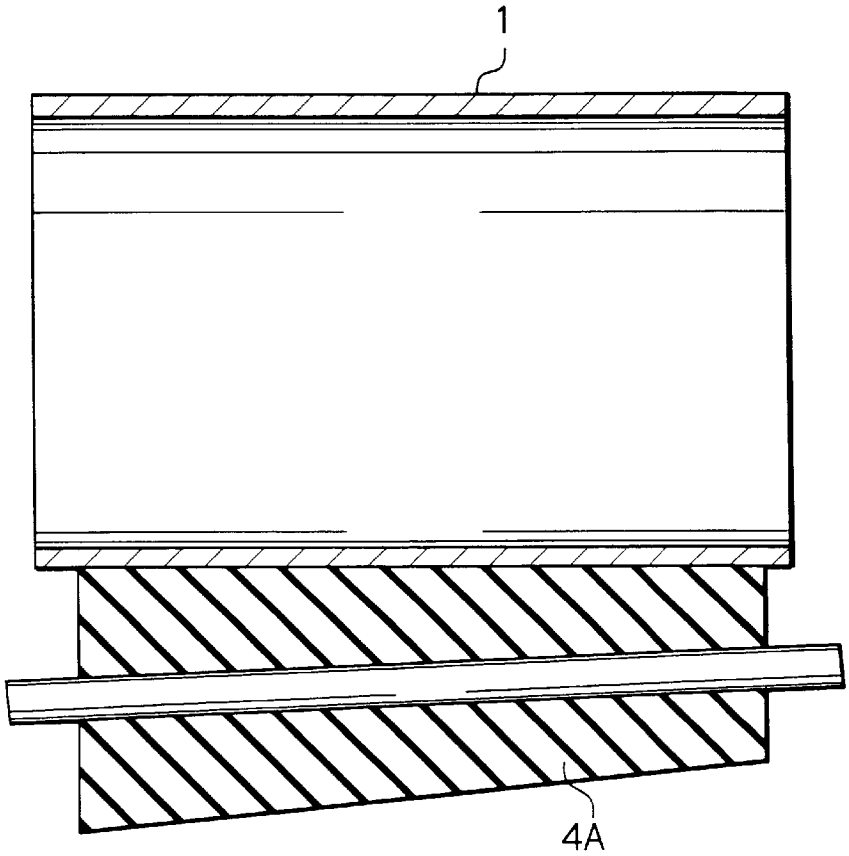
FIG. 4 is a view showing a specific contact condition between an image carrier and a developer carrier achievable with the illustrative embodiment.
Figure 5:
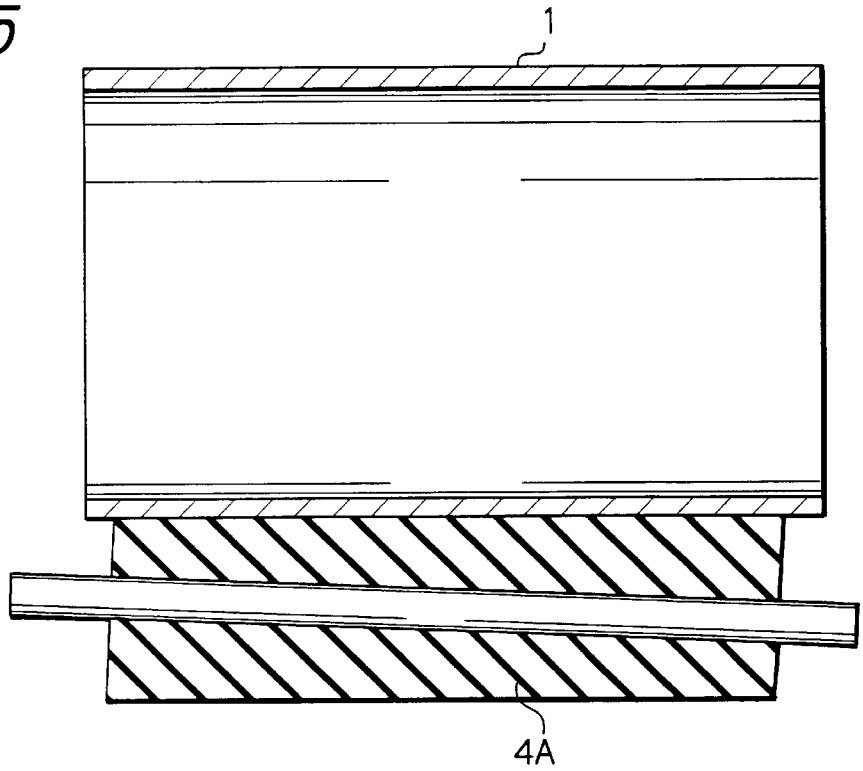
FIG. 5 is a view showing another specific contact condition between the image carrier and the developer carrier achievable with the illustrative embodiment.

In the illustrative embodiment, the maximum distance T in the radial direction is selected to be smaller than the displacement L, as stated above. The maximum distance T is therefore less than 0.05 mm and does not produce any gap. Specifically, as shown in FIGS. 4 and 5, the circumference of the developing roller 4A contacts the drum 1 in parallel to the drum 1, i.e., without any gap. That is, a gap does not appear between the developing roller 4A and the drum 1 even if oscillation or cylindricality differs from a preselected value.

Figure 6:
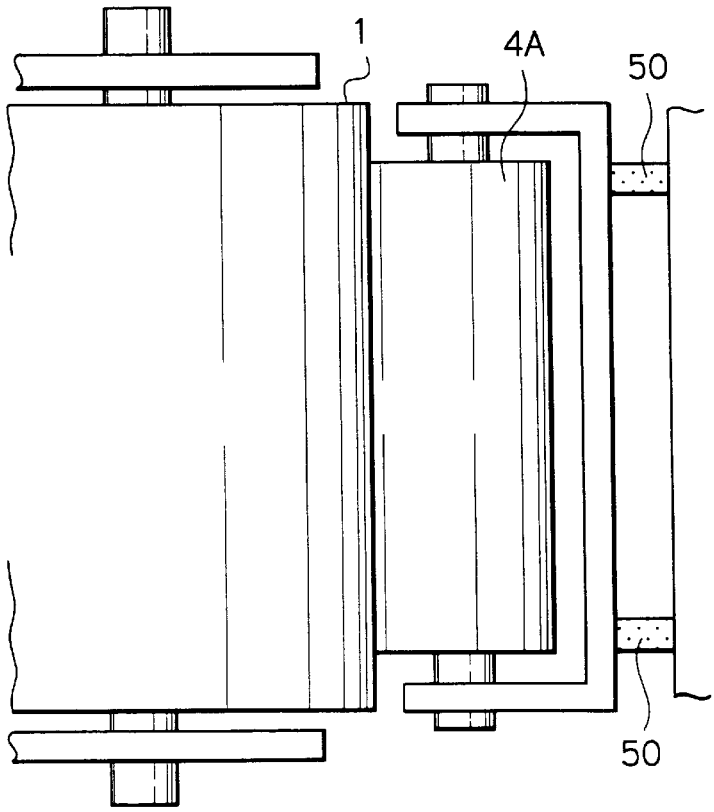
FIG. 6 is a view showing part of the illustrative embodiment including the developer carrier.

Particularly, as shown in FIG. 6, a support section supporting the developing roller 4A includes a plurality of elastic members 50. The elastic members 50 cause the circumference of the developing roller 4A to extend in parallel to that of the drum 1 at a plurality of axial positions including opposite ends. More specifically, a bearing portion supporting the shaft of the developing roller 4A is supported in such a manner as to be movable in the direction perpendicular to the circumference of the drum 1. Therefore, the axially opposite ends of the bearing portion are movable in the above direction independently of each other. In this condition, when the developing roller 4A is moved toward the drum 1 by the displacement L, the roller 4A is automatically positioned such that the circumference thereof is parallel to the circumference of the drum 1. The developing roller 4A can therefore evenly contact the drum 1 in the axial direction without any strict control over oscillation or cylindricality. The elastic members 50 are formed of rubber or a spring material.

As stated above, the illustrative embodiment insures uniform contact of the developing roller 4A and drum 1 simply by setting a particular relation between the distance between the circumference of the drum 1 and that of the developing roller 1 and the displacement of the roller 4A relative to the drum 1. This makes it needless to strictly control the outside diameter, oscillation or cylindricality of the developing roller 4A.

Figure 7:
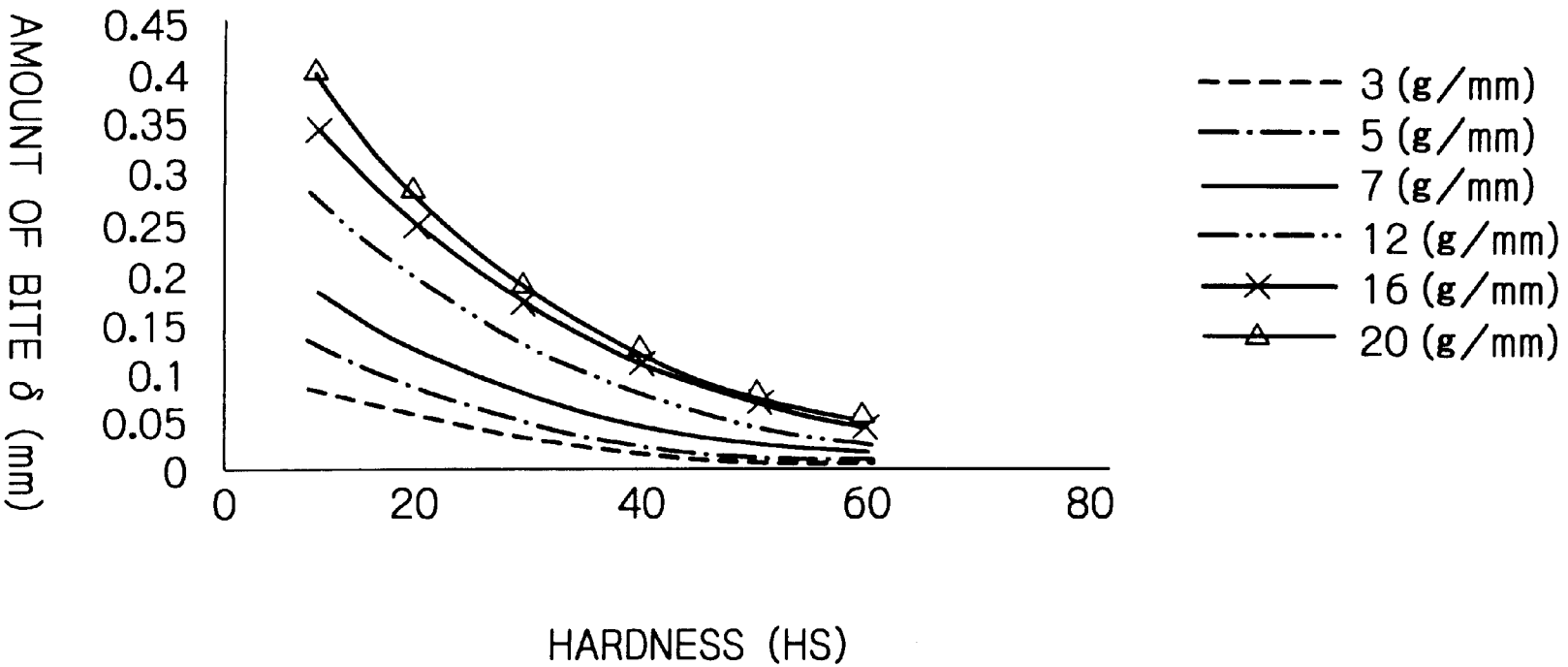
FIG. 7 is a graph showing the characteristic of the developer carrier included in the illustrative embodiment.

How the developing roller 4A contacts the drum 1 is dependent also on the hardness of the surface of the roller 4A, as will be described hereinafter. If the contact pressure of the developing roller 4A acting on the drum 1 is short, the roller 4A fails to scrape off the toner left on the drum 1 after image transfer with expected efficiency. If the contact pressure is excessive, it increases the drive torque and brings about the omission of dots in a halftone image. In light of this, the illustrative embodiment presses the developing roller 4A against the drum 1 with a pressure of 2 g/mm to 8 g/mm More specifically, FIG. 7 shows are relation between the surface hardness of the developing roller 4A and the amount of bite of the roller 4A into the drum 1 whose diameter is 50 mm. As shown, when the distance T of 0.05 mm should be set up between the circumference of the drum 1 and that of the developing roller 4A, the above contact pressure is achievable if the surface hardness of 40°. From the machining standpoint, it is difficult to reduce the distance T to less than 0.05 mm when it comes to an elastic member having low hardness. For this reason, the hardness of 40° achievable with the contact pressure of 7 g/mm when the amount of bite is 0.05 mm is selected as an upper limit. This is successful to prevent machining cost from increasing when gap accuracy lower than the above accuracy is selected.

In the above configuration, the developing roller 4A is provided with hardness implementing a contact pressure corresponding to an amount of bite that corresponds to the displacement of the roller 4A. As a result, machining cost is successfully prevented from increasing when a gap relating to the amount of bite is to be set.

On the other hand, so long as the developing roller 4A has high hardness, it can be ground after molding in order to set up the distance T. However, the developing roller 4A with low hardness cannot be easily ground and has, in many cases, dimensions determined by vulcanization molding. However, the outside diameter of the developing roller 4A is apt to increase at its opposite end portions during molding due to a cooling rate and other conditions, resulting in the configuration shown in FIG. 3.

To solve the above problem, in the illustrative embodiment, the opposite end portions of the developing roller 4A are chamfered. This allows the outside diameter of the intermediate portion of the roller 4A, i.e., the distance T between the roller 4A and the drum 1 to be easily set. Further, seal members for preventing the toner from flying about are often pressed against the opposite end portions of the roller 4A. In this respect, chamfering prevents the surface layer of the roller 4A from sequentially coming off from the end portions due to friction. In the worst case, the surface layer would come off to the image forming area of the roller 4A.

As stated above, the illustrative embodiment achieves various unprecedented advantages, as enumerated below.

(1) The maximum distance T is selected to be smaller than the displacement L, as stated earlier. Therefore, only if a displacement greater than the maximum distance is selected, the developer carrier can uniformly contact the image carrier by canceling the maximum distance. It follows that when the contact pressure is low, contact is guaranteed without resorting to strict control over the tolerance of the outside diameter, oscillation or cylindricality of the developer carrier. Specifically, even when the developer carrier is formed of rubber or similar elastic material that is lower in hardness than metal and difficult to grind, desirable contact is achievable without increasing machining cost and obviates irregular images.

(2) The developer carrier has a surface provided with a particular hardness. Therefore, even when the contact pressure of the developer carrier to act on the image carrier is low, uniform contact is achievable and obviates irregular images.

(3) When the developer carrier is formed of an elastic body higher in hardness than metal, axially opposite end portions of the developer carrier are chamfered in order to easily set up the relation stated in the above item (1). This is successful to easily obviate defective images without increasing machining cost.

(4) Even when the contact of the developer carrier with the image carrier is not uniform due to errors in the section on which the developer carrier is mounted, the circumference of the developer carrier can be parallel to the circumference of the image carrier. In addition, in the above mounting condition, the relation stated in the item (1) allows the developer carrier to uniformly contact the image carrier. Particularly, when other members contact the end portions of the developer carrier, they are prevented from peeling the surface layer of the developer carrier. This prevents the surface characteristic of the developer carrier and therefore the developer feed condition from varying.

Second Embodiment

Figure 8:
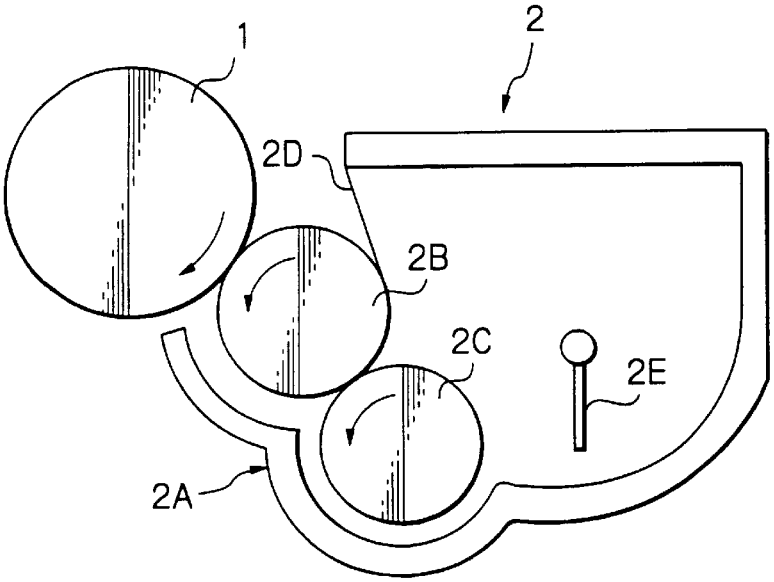
FIG. 8 is a view showing essential part of a second embodiment of the present invention.

FIG. 8 shows an alternative embodiment of the present invention that is directed toward the second object stated earlier. As shown, an image forming apparatus includes a photoconductive drum or image carrier 1 and a developing unit or developer feeding means 2. Again, the developing unit 2 stores a single ingredient type developer or toner. The drum is formed of an organic or inorganic photoconductor and provided with a diameter of 50 mm and a coefficient of friction $\mu$ lying in the range of $0.1 \leqq \mu \leqq 0.4$, as measured on its surface.

Figure 9:
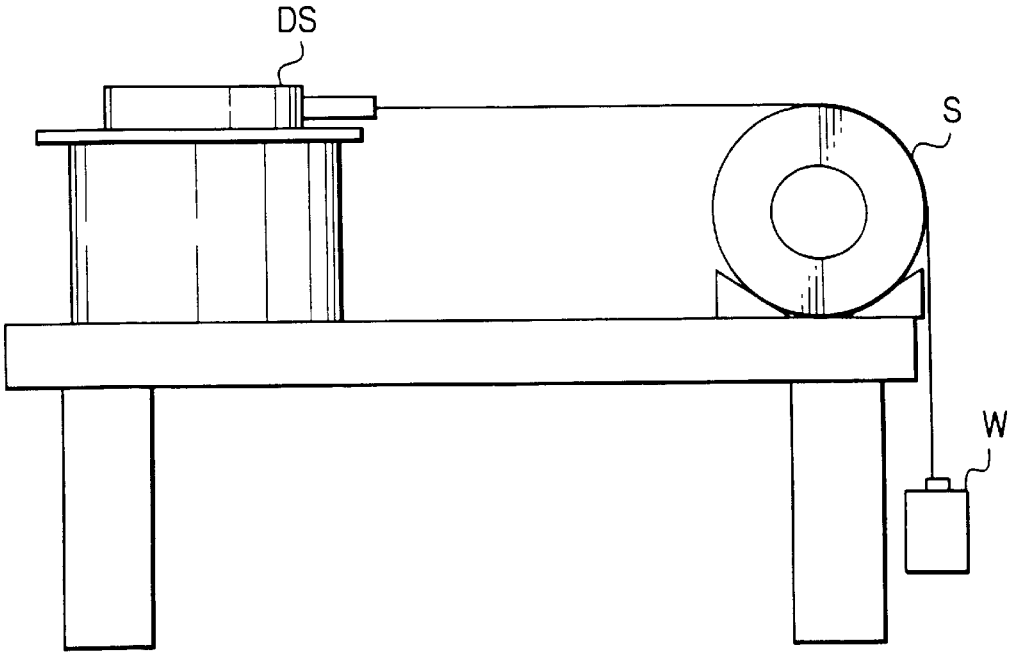
FIG. 9 is a view showing a specific experimental arrangement for determining a coefficient of friction on the surface of an image carrier included in the second embodiment.

FIG. 9 shows an Euler's belt type arrangement used to determine the above range of coefficient of friction $\mu$. As shown, a paper sheet of size A4 (Type 6200 available from Ricoh Co., Ltd.) was cut in a size of 297×30 mm and had its intermediate portion passed over the drum 1 over an angle of 90° ($\pi/2$ rad.). A weight W having a preselected weight of 0.98 N (100 g) was attached to one end of the paper sheet S. A digital push-pull gauge DS was affixed to the other end of the paper sheet S. While the weight W was prevented from swinging, the paper sheet S was pulled at a preselected speed. When the paper sheet S started moving, the value of the gauge DS was read. Assuming that the measured value of the gauge DS is F(N), then the coefficient of friction $\mu$ is produced by:

$$\mu = \ln(F/0.98)/(\pi/2)$$

Among coefficients of friction $\mu$ determined with the above arrangement and procedure, coefficients lying in the following range were determined to prevent the toner from depositing on the drum 1 when the toner was rubbed into the drum 1 by a pressure exerted by the toner layer, and therefore to obviate background contamination.

While the coefficient of friction $\mu$ ranged from 0.4 to 0.6 when a lubricant or similar agent was not applied to the surface of the drum 1, it tended to increase due to aging. By contrast, the drum 1 applied with a lubricant was found to have a coefficient of friction $\mu$ ranging from 0.1 to 0.4. Therefore, if the drum 1 is provided with a coefficient of friction between 0.1 and 0.4, the toner can be prevented from being rubbed into the drum 1, particularly the background, due to friction.

When the toner has a volume mean particle size of 4 $\mu$m to 10 $\mu$m, the above range of coefficients of friction can be maintained if a substance capable of lowering the coefficient of friction of the drum 1, i.e., a so-called lubricant is applied to the drum 1. For this purpose, a lubricant may be directly applied to the drum 1 every time the image forming cycle is repeated a preselected number of times, or applying means loaded with a lubricant may contact the drum 1 either constantly or every time the copying cycle is repeated a preselected number of times. This kind of scheme is taught in. e.g., Japanese Patent Laid-Open Publication No. 4-372981 mentioned earlier.

The drum 1 is charged to a preselected surface potential by conventional charging means and then scanned by conventional optical writing means. As a result, a latent image is electrostatically formed on the drum 1 in accordance with image data.

As shown in FIG. 8, the developing device 2 includes a casing 2A accommodating a developing roller 2B facing the drum 1, a feed roller 2C facing the developing roller 2B, a metering blade or regulating member 2D for regulating the thickness of the toner deposited on the developing roller 2B, and an agitator 2E.

The toner provided in the form of particles consists of a mixture of polyester, polyol, styrene-acryl or similar resin, a charge control agent (CCA) and a coloring agent, and silica, titanium oxide or similar substance applied to the particles. The particles have a mean particle size of 3 $\mu$m to 12 $\mu$m. 7.5 $\mu$m in the illustrative embodiment. With such a mean particle size, it is possible to meet the demand for high resolution (1,200 dpi (dots per inch)) and to further reduce the particle size for even higher resolution.

The developing roller 2B is formed of rubber and provided with an outside diameter of 10 mm to 30 mm. For the rubber, use may be made of silicone rubber, butadiene rubber, nitrile-butadiene rubber (NBR), hydrine rubber or EPDM. The surface of the developing roller 2B may be covered with a silicone- or Teflon-based coating material in order to stabilize quality against aging, if desired. A silicone-based coating material allows the toner to be efficiently charged while the Teflon-based material has a high parting ability. In addition, the coating layer on the developing roller 2B may contain carbon black or similar conductive substance. The coating layer should preferably be 5 $\mu$m to 50 $\mu$m thick; thickness above this range is apt to cause the coating layer to crack. In the illustrative embodiment, the developing roller 2B has lower hardness than the drum 1. Alternatively, use may be made of a hard developing roller and a photoconductive element implemented as a soft belt.

The feed roller 2C is formed of foam polyurethane or similar flexible material having a cell size of 50 $\mu$m to 500 $\mu$m, so that the toner can be easily held on the surface of the roller 2C. The surface of the feed roller 2C has relatively low hardness ranging from 10° to 30° (JIS A scale) so as to evenly contact the developing roller 4A. The surface of the feed roller 2C bites into the developing roller 2B by 0.5 mm to 1.5 mm. The feed roller 2C is rotatable in the same direction as the developing roller 2B such that the surface of the former moves in the opposite direction to the surface of the latter contacting it. The linear velocity ratio of the feed roller 2C to the developing roller 2B is selected to be between 0.5 and 1.5, 0.9 in the illustrative embodiment. When the feed roller 2C is rotated in the opposite direction to the developing roller 2B (in the same direction at the contact position), the linear velocity ratio should preferably be 0.8 to 1.5.

In the illustrative embodiment, the particular range of bite mentioned above implements torque ranging from 1.5 kg·fcm to 2.5 kg·fcm necessary for a unit effective width of 240 mm available with the developing unit 2. This unit effective width corresponds to the width of a paper sheet of size A4 fed in a profile position, as distinguished from a landscape position. However, a broader range of bite may be selected because the amount of bite depends on the characteristics of a motor, gear head and so forth included in a driveline assigned to the developing unit 2 as well as on the charge and feed characteristics of the toner.

Charge is frictionally induced on the toner existing on or in the surface of the feed roller 2C when brought to a nip between the feed roller 4C and the developing roller 2B. In the illustrative embodiment, negative charge is induced on the toner due to the characteristic of the toner. The toner charged to negative polarity is held on the surface of the developing roller 2B due to a conveying effect derived from the surface roughness of the roller 2B. The toner transferred from the feed roller 2C to the developing roller 2B is not uniform in thickness, but deposited to excessive thickness (1 mg/cm$^2$ to 3 mg/cm$^2$). The metering blade 2D regulates such a toner layer to uniform thickness. If desired, the feed roller 2C may be rotated in the opposite direction to the developing roller 2B (in the same direction at the contact position).

The developing roller 2B rotates in a direction indicated by an arrow in FIG. 8. The metering blade 2D is affixed to the casing 2A at one end thereof. The other end of the blade 2D extends to the downstream side in the direction of rotation of the developing roller 2B. In this condition, the blade 2D contacts the circumference of the developing roller 2B at its intermediate portion between the opposite ends in a so-called counter position. The blade 2D is formed of metal, e.g., SUS 304 and 0.1 mm to 0.15 mm thick.

It is to be noted that the metering blade 2D may contact the developing roller 2B in the opposite relation (trailing position) or at its free end.

If desired, the metering blade 2D may be formed of 1 mm to 2 mm thick resin having relatively high hardness, e.g., polyurethane rubber or similar rubber, silicone resin or fluorocarbon resin that inverts the charging characteristic (e.g. ETFE, PTFE or PVdF). Even materials other than metals can be lowered in resistance if, e.g., carbon black is mixed therewith. Such a metering blade 2D can form an electric field between it and the developing roller 28 with a bias applied from a bias power source.

The length of the metering blade 2D between the contact point and the free end should preferably be 8 mm to 15 mm. Lengths greater than 15 mm would make the developing device 2 bulky. Lengths smaller than 8 mm would cause the blade 2D to oscillate on contacting the developing roller 2B and would thereby cause irregularities to appear on an image in the horizontal direction or otherwise make an image defective.

The metering blade 2D contacts the developing roller 2B with a pressure ranging from 1 gf/cm to 25 gf/cm. In this condition, the blade 2D scrapes off non-charged toner particles deposited on the developing roller 2B and regulates the toner layer to uniform thickness. Pressure higher than 25 gf/cm would reduce the amount of toner to deposit on the developing roller 2B and increase the amount of toner charge excessively and would thereby lower image density due to short development. Pressure lower than 1 gf/cm would prevent the toner from forming a uniform thin layer and cause it to move away from the blade 2D in the form of lumps, thereby degrading image quality to a critical degree.

In the illustrative embodiment, the developing roller 2B is implemented by SUS having hardness of 40° (JIS A scale) and thickness of 0.1 mm. The contact pressure is selected to be 6 gf/cm. This allows the metering blade 2D to scrape off excess toner deposited on the developing roller 2B and form a thin toner layer having uniform thickness. The toner with an amount of charge of −5 $\mu$C/g to −30 $\mu$C/g is transferred from the developing roller 2D to a latent image formed on the drum 1.

Figure 10:
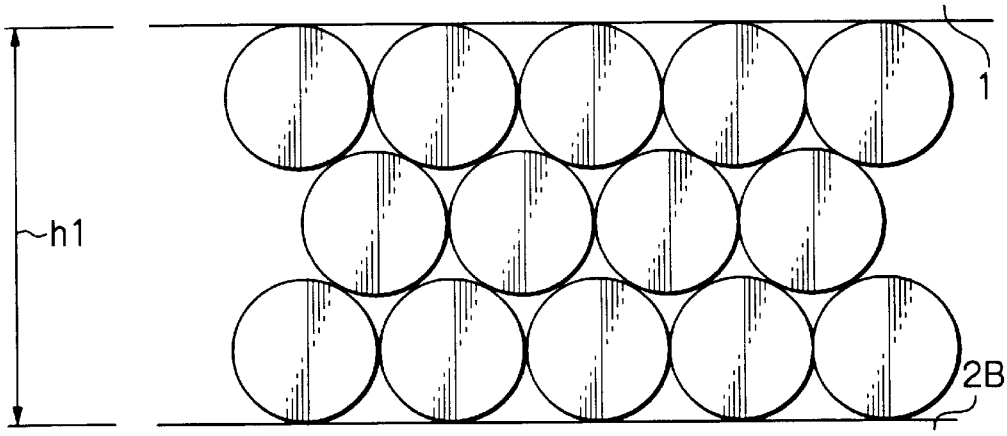
Fig. 10 PRIOR ART
FIG. 10 is a view showing toner particles forming layers between the image carrier and the developer carrier in a conventional configuration.
Figure 11:
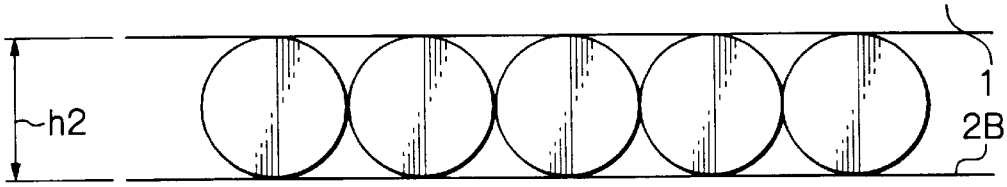
FIG. 11 is a view similar to FIG. 10, showing toner particles forming a substantially single layer in the illustrative embodiment.

The behavior of the toner in the developing region will be described hereinafter. FIGS. 10 and 11 respectively show the deposition of toner to occur in a conventional structure and in the illustrative embodiment. As shown in FIG. 10, in the conventional structure, tone particles deposit in a plurality of layers while the amount of charge sequentially decreases from the bottom layer toward the top layer. Specifically, there holds a relation of a>b>c where a, b and c are representative of consecutive layers. For example, when the toner is charged to −17 μC/g to −20 μC/g, the bottom layer and top layer respectively have an amount of charge of −20 μC/g to −25 μC/g and an amount of charge of −12 μC/g to −17 μC/g. This is because toner particles not sufficiently charged move away from the metering blade 2D due to a short regulating force.

Assume that the drum 1 has the coefficient of friction of 0.4 or below, as stated earlier. Then, an adhering force between the drum 1 and the toner particles tends to decrease. As a result, toner particles in upper layers that are short of charge, compared to toner particles in lower layers, are apt to fly about on the drum 1 and contaminate the background of the drum 1. Further, assume that the degree of cohesion of toner particles and therefore the adhering force acting between the particles increases, as stated earlier. Then, when a halftone image, for example, is developed by using part of the toner deposited on the developing roller 2B, some toner particles are not transferred to the drum 1, preventing a halftone image from being faithfully reproduced.

Another problem with toner particles deposited in multiple layers is that banding occurs in an image due to the irregular rotation of the developing roller 2B. Specifically, when the coefficient of friction of the drum 1 is less than 0.1, any irregularity in the rotation of the developing roller 2B reduces the adhering force to a noticeable degree and prevents some toner particles from being transferred to the drum 1.

Banding also occurs when the contact pressure of the metering blade 2D is not uniform due to the irregular rotation of the developing roller 2B. Specifically, in FIG. 10, toner particles in the layers other than the layer a are short of charge and do not contact the developing roller 21B. Therefore, the adhering force between such toner particles and the developing roller 2B is extremely weak and causes the metering blade 2D to easily scrape off the toner particles, varying the thickness of the entire toner. Consequently, the amount of development is not constant and brings about banding.

In light of the above, as shown in FIG. 11, the illustrative embodiment forms a substantially single toner layer by causing the toner to deposit on the developing roller 2B in an amount M (mg/cm$^2$) lying in the following range:

$$0.5\ \rho Rt \leqq M \leqq 2\ \rho Rt$$

where Rt denotes the volume mean particle size (cm) of the toner, and ρ denotes a bulk density (mg/cm$^3$).

The above relation is achievable by increasing the contact pressure of the metering blade 2D and reducing the length of the part of the blade 2D extending from the developing roller 2B. The single toner layer has a uniform amount of charge and therefore does not bring about background contamination ascribable to short charge. For example, assume that the toner has volume mean particle size (cm) of 7.5 (μm), and specific gravity of 1.2. Then, when the toner is pressed by 100 gf/cm$^2$, the bulk density is 0.6. The lower limit of the amount M is therefore 1.2 aRt=0.27 mg/cm$^2$; amounts M below the lower limit would fail to implement a sufficient amount of development. The upper limit of the amount M is 1.2aRt=0.65 mg/cm$^2$; amounts M above the upper limit would cause an excessive amount of toner to deposit in multiple layers, as stated earlier.

With the above particular relation, the illustrative embodiment prevents the adhering force between toner particles ascribable to cohesion from increasing due to aging. Further, the distance between the drum 1 and the developing roller 2B (labeled h2 in FIG. 11) is far shorter than in the condition shown in FIG. 10, allowing toner particles to easily and faithfully migrate toward a latent image formed on the drum 1.

As for banding, the metering blade 2D does not scrape off the upper toner layers even though its pressure may vary. More specifically, because the toner firmly deposits on the developing roller 2B on the basis of a mirror image force and van der Waals' forces, the toner is scraped off little despite the variation of the contact pressure and therefore changes its thickness little. This successfully reduces banding. To set the desired amount of development on the drum 1, the linear velocity ratio of the developing roller 2B to the drum 1 should preferably be 1.5 to 2.0.

In the illustrative embodiment, the nip between the drum 1 and the developing roller 2B has a width W lying in the range of 0.3≦W≦3.0. Nip widths greater than 3.0 lower the uniformity of the toner and make a solid image irregular because a scavenging effect that causes the developing roller 2B to scrape off the toner from the drum 1 increases. This depends on the hardness and contact condition of the developing roller 2B.

To implement desired image density and to avoid background contamination, the linear speed ratio Vd/Vp of the developing roller 2B to the drum 1 must be 1.0 or above. However, an excessively great linear speed ratio causes the toner to deposit only on the trailing edge portion of a solid image, rendering the solid image defective. This stems from the fact that even after the trailing edge of a latent image has been developed, toner deposited on part of the developing roller 2B newly facing the drum 1 due to the rotation of the roller 2B deposits on the trailing edge within the developing region. It follows that as the nip width decreases, it reduces the period of time over which the trailing edge moves over the developing region and therefore excessive toner, thereby rendering the above occurrence inconspicuous. Nip widths less than 0.3 mm would practically cancel the scavenging effect and would cause the background of the drum 1 to be contaminated.

The illustrative embodiment obviates the above defective images and the background contamination of the drum 1 by defining a particular nip width.

Further, the illustrative embodiment confines a contact surface pressure P (gf/cm$^2$) between the drum 1 and the developing roller 2B in the range of 1.0≦P≦5.0. Contact surface pressures above 5.0 gf/mm$^2$ increase the previously discussed scavenging effect and degrade the uniformity of a solid image. In addition, such pressures would increase the drive torque of the developing roller 2B and make the rotation of the roller 2B irregular, resulting in banding. Contact surface pressures below 1.0 gf/cm$^2$ would cancel the scavenging effect and would prevent the bite of the developing roller 2B into the drum 1 from absorbing the dimensional error of the roller 2B. The illustrative embodiment therefore obviates banding and therefore an irregular image.

(1) When the developer is pressured by 100 gf/cm$^2$, the relation of 0.5 ρRt≦M≦1.2 ρRt holds between the volume mean particle size Rt (cm) of the developer, the amount M of the developer to deposit on the developer carrier, and the bulk density ρ (gf/cm$^3$). The developer deposits on the developer carrier in a substantially single layer and therefore has a uniform amount of charge. This surely obviates short charge that would cause the developer to fly about and contaminate the background of the image carrier. Adhesion of toner particles ascribable to cohesion does not occur despite aging. Further, the distance between the image carrier and the developer carrier is short enough to allow the developer to easily and faithfully migrate from the developer carrier toward a latent image formed on the image carrier, realizing a uniform solid image and a uniform halftone image. Moreover, the regulating means contacts the developer carrier via the developer and contacts the developer at its end or intermediate portion. This prevents the contact pressure of the regulating means from varying and thereby accurately determine the thickness of the single developer layer. Consequently, there can be surely obviated irregularities in the horizontal direction and banding.

(2) The nip width W between the image carrier and the developer carrier lies in the range of $0.3 \leqq W \leqq 3.0$ (mm). This nip width W allows the developer carrier to scrape off the developer from the image carrier with an adequate scavenging effect, thereby insuring a uniform solid image and obviating the local concentration of the developer at the trailing edge of a solid image.

(3) The contact surface pressure P (gf/cm$^2$) between the image carrier and the developer carrier lies in the range of $1.0 \leqq P \leqq 5.0$. This pressure P prevents the scavenging effect from increasing and making a solid image irregular and obviates banding ascribable to the irregular rotation of the developer carrier caused by an increase in the drive torque of the developer carrier. Further, the above pressure P prevents the scavenging effect from being cancelled and obviates irregular images by absorbing the dimensional error of the developer carrier with the bite of the developer carrier into the image carrier.

Third Embodiment

Figure 12:
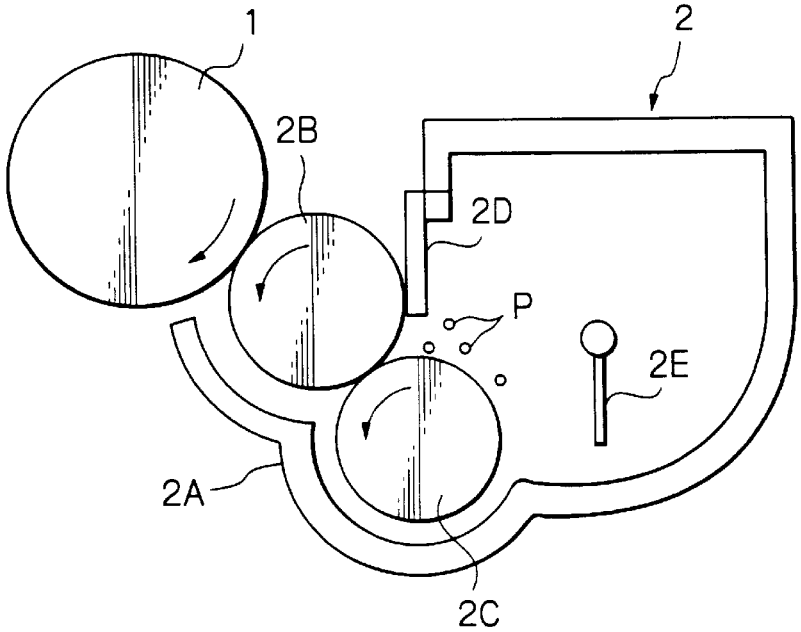
FIG. 12 is a view showing essential part of the first and second embodiments.

Referring to FIG. 12, a third embodiment of the present invention will be described. This embodiment is also directed toward the second object stated earlier. In FIG. 12, structural elements identical with the structural elements shown in FIG. 8 are designated by identical reference numerals. The surface of the drum 1 has a coefficient of friction $\mu$ lying in the range of $0.1 \leqq \mu \leqq 0.4$, as in the second embodiment.

The toner provided in the form of particles consists of a mixture of polyester, polyol, styrene-acryl or similar resin, a charge control agent (CCA) and a coloring agent, and silica, titanium oxide or similar substance applied to the particles. The coloring agent may be carbon black. Phtalocyanine Blue or quinacridone by way of example.

The particles have a mean particle size of 3 $\mu$mm to 12 $\mu$m, 7.5 $\mu$m in the illustrative embodiment. With such a mean particle size, it is possible to meet the demand for high resolution (1,200 dpi (dots per inch)) and to further reduce the particle size for even higher resolution. Further, the above kind of additive is applied to the surfaces of the toner particles consisting of polyester, polyol, styrene-acryl or similar resin, CCA, coloring agent and, if necessary, wax. The additive has a particle size ranging from 0.1 $\mu$m to 1.5 $\mu$m.

The developing roller 2B is formed of rubber and has a preselected surface roughness. The rubber contains ferrite or similar magnetic material and magnetized and has its surface covered with a coating material, as in the previous embodiments.

One end of the metering blade 2D is affixed to the casing 2A. Assume a direction tangential to the position where the blade 2D faces the developing roller 2B. Then, the other end of the blade 2D extends to the downstream side with respect to the direction of rotation of the developing roller 2B with an inclination of 10° to 45° relative to the above tangential direction. The portion of the blade 2D closer to the base end than to the free end contacts the developing roller 2B. The blade 2D is formed of SUS304 or similar metal and provided with a thickness of 0.1 mm to 0.15 mm. The length of the blade 2D between the opposite ends is 10 mm to 15 mm. The blade 2D contacts the developing roller 2B with a pressure of 5 gf/cm to 50 gf/cm.

In the illustrative embodiment, assuming that the developing roller 2B has hardness of 30° (JIS A scale), then the metering blade 2D is formed of 0.1 mm thick SUS and provided with a contact pressure of 20 gf/cm. In this condition, the target amount of toner to deposit on the developing roller 2B is 0.4 mg/cm$^2$ to 0.8 mg/cm$^2$. In this case, the amount of charge to depot on the toner is between −8 $\mu$C/g and −30 $\mu$C/g. The developing roller 2B contacts a latent image formed on the drum 1 via the toner layer to thereby develop the latent image.

By so limiting the length of the metering blade 2D, it is possible to prevent the apparatus from being bulky or prevent the blade from easily oscillating due to an excessive length. The oscillation of the blade 2D would prevent the toner layer on the developing roller 2B from being uniform in thickness. Irregular deposition of toner would, in turn, render irregular image density conspicuous in the resulting image. Further, by limiting the contact pressure, it is possible to prevent the amount of charge to deposit on the toner from increasing due to the short deposition of the toner on the developing roller 2B. The short deposition is apt to occur when the contact pressure is above the upper limit. This is successful to obviate the short transfer of the toner to the drum 1 and therefore short image density. In addition, the toner is prevented from being conveyed past the metering blade 2D in the form of lumps and rendering the resulting image defective. This is apt to occur when the contact pressure is below the lower limit.

Coil springs, leaf springs or similar pressing means press the developing roller 2B against the drum 1 via the toner layer. In the illustrative embodiment, when the developing roller 2B has hardness (HS) of 30° (JIS A scale), the contact pressure is selected to be 2 gf/mm to 6 gf/mm. To guarantee the uniform density of a solid image, as many pressing means as possible should preferably be arranged in the axial direction of the developing roller 2B for reducing irregular contact between the roller 2B and the drum 1.

The above contact pressure has influence on the uniform development of a solid image and the prevention of background contamination and is set on the basis of the following results of experiments. FIG. 13 is a table showing a relation between hardness and contact pressure and the occurrence of defective images (non-uniform solid image and background contamination) determined by experiments. As shown, the developing ability was too low to implement a sufficient amount of development when the contact pressure was below the lower limit of the above range (see the range indicated by oblique lines extending rightward downward). When the contact pressure was above the upper limit, the scavenging force of the developing roller 2B was increased while the toner layer was compressed and caused to cohere. Consequently, the toner transferred to the drum 1 was scraped off or left on the developing roller 2 in the cohered condition, resulting in defective images including solid images with irregular density. When the contact pressure lies in the above range for the above hardness of the developing roller 2B, uniform images with high density are achievable.

Figures 14, 15:
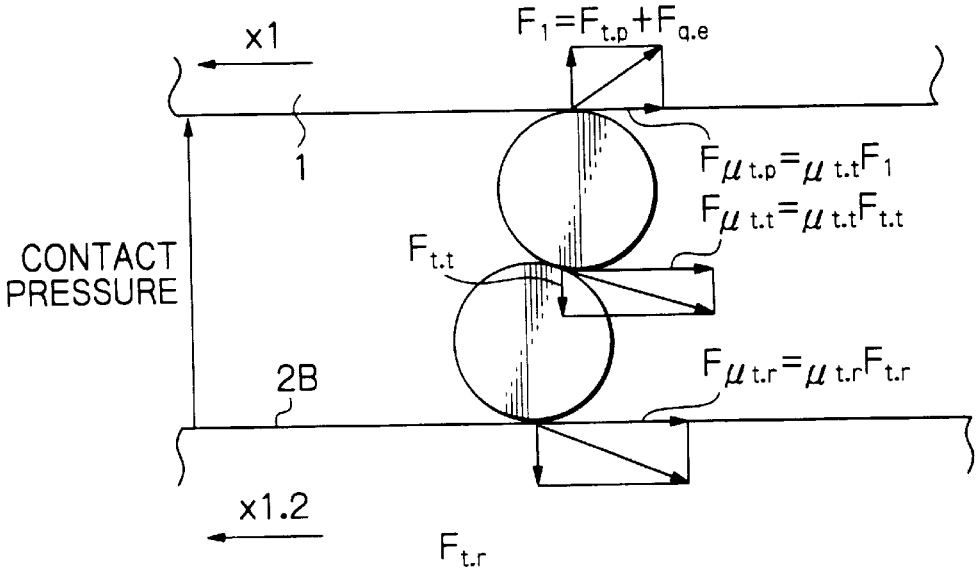
FIG. 14 is a table showing a relation between the loose apparent density of toner and the reproducibility of a halftone image.
FIG. 15 is a view showing a relation between a cohering force to act between developer particles and a force causing them to migrate to a latent image.

The fluidity of the toner is a parameter having influence on the deposition of the toner on the drum 1. A loose apparent specific gravity is an index for this parameter. In the illustrative embodiment, the loose apparent specific gravity is selected to be 0.35 g/cm$^2$ or above. FIG. 14 lists the results of experiments conducted with different values of loose apparent specific gravity for determining the reproducibility of a halftone image. As shown, toner A and toner B respectively had loose apparent densities of 0.3 and 0.42. The developing roller 2B was pressed against the drum 1 by a contact pressure of 6 gf/mm and rotated at a linear velocity ratio of 1.2 to the drum 1 so as to form a halftone image. For the experiments, use was made of Powder Tester Type PT-N available from HOSOKAWA MICRON CORP. In FIG. 4, a circle and a cross indicate high reproducibility and low reproducibility, respectively. While loose apparent density indicates the degree of fluidity when a packing ratio is measured, it increases with an increase in fluidity.

FIG. 15 demonstrates how a halftone image becomes non-uniform. Generally, development is effected by forces acting between toner and a latent image. Assume that a non-electrostatic adhering force $F_{t,p}$ acting between the toner and a photoconductive drum and a Coulomb force $F_{q,a}$ acting on the toner are the forces to act on the toner. The toner migrates toward a latent image and develops it when the sum of the above forces is greater than the sum of an adhering force $F_{t,t}$ acting between toner particles and a non-electrostatic adhering force $F_{t,r}$ acting between the toner and a developing roller:

$$F_{t,p}+F_{q,a}>F_{t,t}+F_{t,r}$$

On the other hand, assume that the contact pressure increases the cohering force between toner particles when the metering blade 2D regulates the toner layer or when a latent image on the drum 1 is developed. Then, the above adhering force $F_{t,t}$ between toner particles locally increases and prevents part of the toner from migrating, resulting in the local omission of an image.

Forces shown in FIG. 15 and including the above forces are listed below:

Forces Perpendicular to Circumference of Developing Roller 2B

- $F_{t,p}$: non-electrostatic adhering force acting between toner and drum
- $F_{q,a}$: Coulomb force acting on toner
- $F_{t,t}$: adhering force acting between toner
- $F_{t,r}$: non-electrostatic adhering force acting between toner and developing roller 2B Forces Perpendicular to Developing Direction

- $F\mu_{t,p}$: frictional force acting between toner and drum 1 ($\mu_{t,p}$ denoting coefficient of friction)
- $F\mu_{t,t}$: frictional force between toner ($\mu_{t,t}$ denoting coefficient of friction)
- $F\mu_{t,r}$: frictional force acting between toner and developing roller 2B ($\mu_{t,r}$ denoting coefficient of friction)

In FIG. 15, when the adhering force $F_{t,t}$ between the toner particles increases, the cohering force between the particles increases and obstructs the migration of the particles to the drum 1.

In light of the above, the illustrative embodiment uses additives for regulating the cohering force of toner ascribable to the adhering force acting between toner particles. Specifically, the current toner contains 0.2 wt % of silica and 0.3 wt % of titanium oxide. For toner B shown in FIG. 14, the illustrative embodiment selects 0.5 wt % of silica and 1 wt % of titanium oxide that are greater in ratio than the additives of toner A. With these additives, it is possible to lower the cohering force acting between toner particles and therefore to prevent toner particles from forming lumps. The toner can therefore contact the drum 1 in a loosened condition, insuring uniform development and uniform transfer characteristic.

Figures 16, 17:
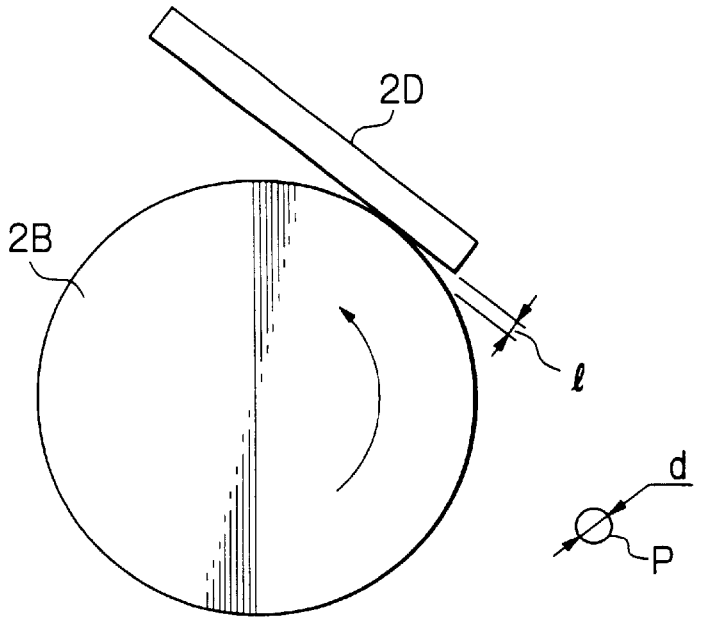
FIG. 16 is a table showing a relation between the sphericality of toner particles and the reproducibility of a halftone image.
FIG. 17 is a view showing a relation between the image carrier and regulating means included in the arrangement of FIG. 12.

Further, the following experiments were conducted to determine a relation between the sphericality of toner particles and the reproducibility of a halftone image. FIG. 16 shows the results of experiments. Specifically, how the reproducibility of a halftone image is effected by the sphericality of toner particles was determined on the assumption that the sphericality of true sphere was 1. As shown in FIG. 16, toner C and toner D respectively had sphericality of 0.88 and sphericality of 0.96. The developing roller 2B was pressed against the drum 1 by a contact pressure of 6 gf/mm and rotated at a linear velocity ratio of 1:2 to the drum 1 for forming a halftone image. 0.6 wt % of silica was used as an additive. As FIG. 16 indicates, for a given amount of additive, the higher sphericality increases a covering ratio corresponding the amount of deposition of an additive that varies in accordance with the surface area of a toner particle, which in turn varies in accordance with sphericality. As a result, the adhering force between toner particles increases little despite the contact pressure when the metering blade 2D forms a thin layer or during development of a latent image. This promotes uniform development and thereby enhances the reproducibility of a halftone image. To produce spherical toner particles, there may be used polymerization or a method that heats pulverized toner particles for restoring the surfaces of the particles to the original state.

As stated above, by controlling the amounts of additives and the configuration of toner particles, it is possible to reduce the cohering force to act between the toner particles and therefore to insure a uniform, dense image even when a latent image has low contrast.

FIG. 17 shows a relation between the developing roller 2B and the metering blade 2D shown in FIG. 12. As shown, the developing roller 2B is implemented as a magnetic roller having an outside diameter of 16 mm and including an elastic layer and a surface layer one of which contains a magnetic material. The developing roller 2B has sixty magnetic poles. The casing 2A stores a mixture of toner and magnetic particles P each having a size of 100 $\mu$mm to 300 $\mu$mm. The magnetic particles P should preferably be covered with, e.g., silicone resin. The free end of the metering blade 2D is spaced from the circumference of the developing roller 2B by a distance or height l. The size of each magnetic particle P is greater than the height l. Therefore, when the magnetic particles P contact the toner particles not regulated by the metering blade 2D, the magnetic particles P can scrape off a small amount of toner particles. In addition, the particles P existing between the toner particles can loosen the toner particles to thereby obviate cohesion.

Why the magnetic particles P are mixed with the toner particles will be described more specifically. Factors that increase the adhering force to act between the toner particles are the fluidity of toner (loose apparent density), the contact pressure between the metering blade 2D and the developing roller 2B, and the contact pressure between the drum 1 and the developing roller 2B, as stated earlier. The toner is fed to the developing roller 2B by way of the feed roller 2C in order to feed a sufficient amount of toner even to a low contrast image while insuring the development of a solid image. At this instant, the amount of toner to deposit on the developing roller 2B sometimes exceeds 1 mg/cm$^2$. As a result, the contact pressure between the metering blade 2D and the developing roller 2B and therefore the adhering force acting between the toner particles increases. In this respect, the magnetic toner particles P contacting part of the toner particles not regulated are successful to crape off part of such toner particles while loosening the toner particles. It follows that when the above contact pressure is constant, the adhering force between the toner particles can be reduced in accordance with the decrease in the degree of cohesion.

Because the developing roller 2B is magnetic, the magnetic particles P are conveyed by the roller 2B to the inlet between the metering blade 2D and the developing roller 2B. At this instant, the magnetic particles P and toner particles are agitated together and charged by friction. Consequently, the toner particles deposit on the magnetic particles P and scraped off thereby.

Part of the toner particles and magnetic particles P is prevented from advancing toward the position where the developing roller 2B and metering blade 2D face each other by the blade 2D. This part of particles drops onto the feed roller 2C or into the casing 2A because the size of the magnetic particles P is greater than the height of the above inlet. Moreover, the particles obstructed by the metering blade 2D are not passed through the position where the blade 2D contacts the developing roller 2B, because of the sufficient contact pressure (2.0 gf/mm). At this position, the particles P scraped off by the metering blade 2D drop, due to gravity, to the position where the developing roller 2B and feed roller 2C contact each other, so that the surface layer of the drum 1 is protected from damage.

In summary, the illustrative embodiment has the following various unprecedented advantages (1) through (3).

(1) The developer has a loose apparent density selected to be 0.35 or above in order to reduce the cohering force acting between the particles of the developer. The developer can therefore deposit on the image carrier in a loosened condition and therefore insures a uniform halftone image and a uniform image transfer characteristic.

(2) Sphericality is used to define the configuration of each developer particle and selected to be 90% or above with respect to true sphericality. Therefore, for a given amount of additive, higher sphericality increases a covering ratio corresponding the amount of deposition of an additive that varies in accordance with the surface area of a toner particle, which in turn varies in accordance with sphericality. As a result, the adhering force between the toner particles increases little. This promotes uniform development and thereby enhances the reproducibility of a halftone image.

(3) The developer contains a plurality of particles, particularly magnetic particles having a size greater than the distance between the regulating member and the image carrier. The magnetic particles reduce the adhering force to act between the toner particles and thereby prevent the developer from forming lumps. This is also successful to promote uniform development and to enhance the reproducibility of a halftone image.

Various modifications will become possible for those skilled in the art after receiving the teachings of the present disclosure without departing from the scope thereof.

What is claimed is:

1. A developing method for a latent image on an image surface of an image carrier, comprising:

providing a cylindrical developer carrier having a surface hardness lower than the surface hardness of the image carrier in contact with said image surface at least at two spaced apart points, with the cylindrical developer carrier surface being out of contact with the image surface between the two spaced apart points;

moving opposite ends of said cylindrical developer carrier different distances relative to one another to bring the cylindrical developer carrier surface and the image surface between the two spaced apart points into contact to form a full contact region between the two spaced apart points; and transferring a single ingredient type developer from the cylindrical developer carrier surface to the image surface over the full contact region between the two spaced apart points to develop the latent image without density irregularities arising because of the absence of full contact between the cylindrical developer carrier surface and the image surface.

2. A method as claimed in claim 1 wherein said developer carrier is chamfered at axially opposite end portions thereof.

3. A method as claimed in claim 1, wherein said developer carrier has a surface hardness of 40° (JIS A scale) or below.

4. A method as claimed in claim 1 further comprising a step of:

scraping a layer of the single ingredient developer on the developer carrier to an amount M, wherein the amount M is defined to be $0.5\ mg/cm^2 \leqq M \leqq 2\ mg/cm^2$.

5. A method as claimed in claim 1 further comprising a step of:

transferring a layer of the single ingredient developer from the developer carrier to the image carrier, the transferred layer having an amount of charge of from $-5\ \mu C/g$ to $-30\ \mu C/g$.

6. A latent image developing apparatus comprising:

a section configured to form a latent image on an image surface of an image carrier;

a developing unit including a cylindrical developer carrier having a surface hardness lower than that of the image carrier, the developing unit being configured to provide contact at least at two spaced apart points on a developer surface of the cylindrical developer carrier and said image surface, with the developer surface and the images surface being out of contact between the two spaced apart points to form a gap; and a moving mechanism configured to move opposite ends of the cylindrical developer carrier independent distances relative to one another to eliminate said gap and establish a full contact region between the image surface and the developer surface between and including the two points to transfer a single ingredient type developer from the developer surface to the image surface in the full contact region to develop the latent image without density irregularities that would result if the gap had not been eliminated.

7. An apparatus as claimed in claim 6, wherein said developer carrier is supported such that a circumference of said developer carrier becomes parallel to a circumference of said image carrier when moved toward said carrier due to biasing.

8. An image forming apparatus as claimed in claim 6, wherein said developer carrier has a surface hardness of 40° (JIS A scale) or below.

9. An image forming apparatus as claimed in claim 6 further comprising:

a metering blade configured to scrape the single ingredient developer deposited in a layer on the developer carrier to an amount M, wherein the amount M is defined to be $0.5\ mg/cm^2 \leqq M \leqq 2\ mg/cm^2$.

10. An image forming apparatus as claimed in claim 6 wherein the single ingredient developer deposited on the image carrier to form the latent image has an amount of charge of from $-5\ \mu C/g$ to $-30\ \mu C/g$.

* * * * *